US006209751B1

(12) United States Patent
Goodin et al.

(10) Patent No.: US 6,209,751 B1
(45) Date of Patent: Apr. 3, 2001

(54) FLUID DISPENSER

(75) Inventors: John W. Goodin, Coto de Caza; Peter A. Regla, Placentia; Kenneth B. Gerenraich; Edward M. Pribonic, both of Seal Beach, all of CA (US)

(73) Assignee: Woodward Laboratories, Inc., Los Alamitos, CA (US)

( * ) Notice: Subject to any disclaimer, the term of this patent is extended or adjusted under 35 U.S.C. 154(b) by 0 days.

(21) Appl. No.: 09/395,435

(22) Filed: Sep. 14, 1999

(51) Int. Cl.[7] ..... B67D 5/00
(52) U.S. Cl. ..... 222/52
(58) Field of Search ..... 222/52, 181.1, 222/181.3, 207, 212, 325, 544, 547, 559; 141/351

(56) References Cited

U.S. PATENT DOCUMENTS

| | | | | |
|---|---|---|---|---|
| 4,449,122 | | 5/1984 | Whitmer | 340/562 |
| 4,722,372 | | 2/1988 | Hoffman et al. | 141/98 |
| 4,879,461 | | 11/1989 | Philipp | 250/221 |
| 4,917,265 | * | 4/1990 | Chiang | 222/52 |
| 4,921,131 | | 5/1990 | Binderbauer et al. | 222/52 |
| 4,938,384 | | 7/1990 | Pilolla et al. | 222/52 |
| 4,967,935 | | 11/1990 | Celest | 222/63 |
| 5,086,526 | | 2/1992 | Van Marcke | 4/623 |
| 5,199,118 | | 4/1993 | Cole et al. | 4/619 |
| 5,217,035 | | 6/1993 | Van Marcke | 137/1 |
| 5,492,247 | | 2/1996 | Shu et al. | 222/63 |
| 5,625,908 | | 5/1997 | Shaw | 4/623 |
| 5,632,414 | | 5/1997 | Merriweather, Jr. | 222/52 |
| 5,651,044 | | 7/1997 | Klotz, Jr. et al. | 378/117 |
| 5,730,165 | | 3/1998 | Philipp | 137/1 |
| 5,781,942 | | 7/1998 | Allen et al. | 4/623 |
| 5,836,482 | * | 11/1998 | Ophardt et al. | 222/52 |
| 5,933,288 | | 8/1999 | Plesko | 359/896 |
| 5,952,835 | | 9/1999 | Coveley | 324/671 |
| 5,960,991 | * | 10/1999 | Ophardt | 222/52 |

* cited by examiner

*Primary Examiner*—Lesley D. Morris
(74) *Attorney, Agent, or Firm*—Walter A. Hackler

(57) ABSTRACT

A fluid dispenser includes a disposable reservoir for containing a fluid and a tube depending therefrom for dispensing measured quantities of fluid. The tube includes a fluid dispensing orifice and a plunger for forcing measured quantities of fluid through the orifice. A solenoid disposed adjacent tube magnetically engages and moves the plunger in order to cause the plunger to force the measured quantities of fluid through the orifice. A control system is provided which includes a Theremin antenna for sensing the presence of a user's hand beneath the orifice and providing electrical current to the solenoid to enable the solenoid to magnetically engage and move the plunger.

32 Claims, 6 Drawing Sheets

FLUID DISPENSER

The present invention generally relates to automatic dispensers and more particularly relates to automatic fluid dispensers for providing a metered amount of liquid soap, or the like, on sensing the presence of a user's hand.

Many automatic fluid dispensers have been developed and have general use in restaurants, hotels, theaters, and the like. The dispensers are typically activated by light, such as infrared sensors. Heretofore developed dispensers typically are prone to clogging which renders the dispenser unusable, or leaking, the latter causing an unsafe situation.

Further, heretofore developed devices for the automatic dispensing of a measured amount of liquid are prone to falsely sensing the presence of a user and dispensing unwanted soap.

It should be easily appreciated that falsely triggered soap, or the like, when disposed on sink surfaces and floors produces slippery, unsafe surfaces which may result in injury to the public.

This problem is recognized in U.S. Pat. No. 4,967,935, which attempted to solve the problem of false operation by using an elaborate control drive circuit which included the emission of an optical signal of predetermined wavelengths in the infrared spectrum and of a predetermined configuration along with optical detection means, responsive to the wavelength and configuration of the optical signal, for actuating a timed control signal, in order to apply power to actuate a rotary motor to dispense fluid.

Such elaborate control systems still do not solve non triggering due to the presence of dark clothing or dark skin pigmentation. In addition, false triggering is known to occur by light reflected from porcelain sinks, from fluorescent light ballast or from camera flash.

The present invention provides for a fluid dispenser utilizing a disposable nozzle system wherein is self-cleaning in order to eliminate the problem of clogging. In addition, a control system to provide for actuating the dispenser which is virtually free of false triggered operation. In addition, the present invention provides for a touch free pumping action to dispense fluids which simulates manually operated fluid dispensers.

SUMMARY OF THE INVENTION

A fluid dispenser in accordance with the present invention generally includes a reservoir which provides a means for containing a fluid and tubular means, depending from the reservoir, for receiving fluid therefrom by the force of gravity, and for dispensing measured quantities of the fluid.

The tubular means generally includes an orifice and a valve seat disposed at a dispensing end of the tubular means. The reservoir means and tubular means may be disposed in a housing and may be removable as an integral unit therefrom. Accordingly, because the orifice and valve seat are replaced by a change of reservoir, possible clogging of the dispensing end of the tubular means due to prolonged use is eliminated.

A plunger is provided and slidably disposed within the tubular means for movement between a first and a second position. The plunger includes an opening therethrough for enabling fluid to flow past the plunger and a valve face is provided on the plunger for sealably engaging the valve seat when the plunger is in the first position.

A solenoid is provided and disposed in the housing adjacent the tubular means for magnetically engaging and moving the plunger from the first position to the second position upon activation of the solenoid by electrical current. The second position of the plunger is above the first position with the valve face disengaged from the valve seat. Movement of the plunger to the second position causes flow past the plunger into a tubular lower portion.

Spring means are provided and disposed within the tubular means for forcing the plunger to the first position upon deactivation of the solenoid means in order to force fluid in the tubular means lower portion through the orifice. Because the spring means is disposed in the tubular means, it is, of course, disposable therewith and, accordingly, problems of the spring fatigue or sticking due to prolonged use, are eliminated. Further, the spring provides sealing pressure between the valve face and the valve seat which prevents any fluid leakage. Thus, a positive shutoff is provided with no subsequent dripping of fluid.

Additionally, the valve face and valve seat are self-cleaning due to the mating angular surface structure provided on the valve face and valve seat. The angular surfaces provide a sliding engagement therebetween which expels any coagulated, or hardened, fluid through the orifice.

A control means is provided for sensing the presence of a user's hand beneath the orifice and providing electrical current to the solenoid means for a duration of time.

More particularly, the solenoid means has a torroidal shape and is fixed to the housing with the tubular means being removably disposed therethrough.

Preferably, the dispenser includes a first one-way valve for preventing fluid in the tubular means lower portion from flowing past the plunger as the plunger moves to the first position and enabling fluid in the tubular means upper portion to flow into the tubular means lower portion as the plunger moves to the second position.

Additionally, a second one-way valve is preferably provided for preventing fluid flow out of the tubular means upper portion as the plunger moves to the second position while enabling fluid flow into the tubular means upper portion as the plunger moves to the first position.

The control means in accordance with the present invention preferably includes a Theremin antenna for sensing the presence of a user's hand and, more particularly, the control means may include a second sensor means for sensing the presence of a user's hand and processing means for providing electrical current to the solenoid means only upon confirmation of both the Theremin antenna and the second sensor means sensing the presence of user's hand.

Preferably, the Theremin antenna is disposed at a bottom of the housing and in a spaced apart relationship with the valve seat and orifice in order to prevent any interference therebetween. An aperture is provided through the Theremin antenna for passage of fluid therethrough.

To provide greater coupling, or sensing of a user's palm, the Theremin antenna may include upstanding portions which, in combination with a relatively horizontal portion, enables the antenna to generally conform to a shape of the user's palm.

The plunger, valve seat an antenna are virtually aligned which enables vertical upward and downward movement of the user's palm, like a conventional manual pumping of a level, to cause repeated discharge of fluid from the dispenser.

BRIEF DESCRIPTION OF THE DRAWINGS

The advantages and features of the present invention will be better understood by the following description when considered in conjunction with the accompanying drawings, in which.

DETAILED DESCRIPTION

Figure 1:
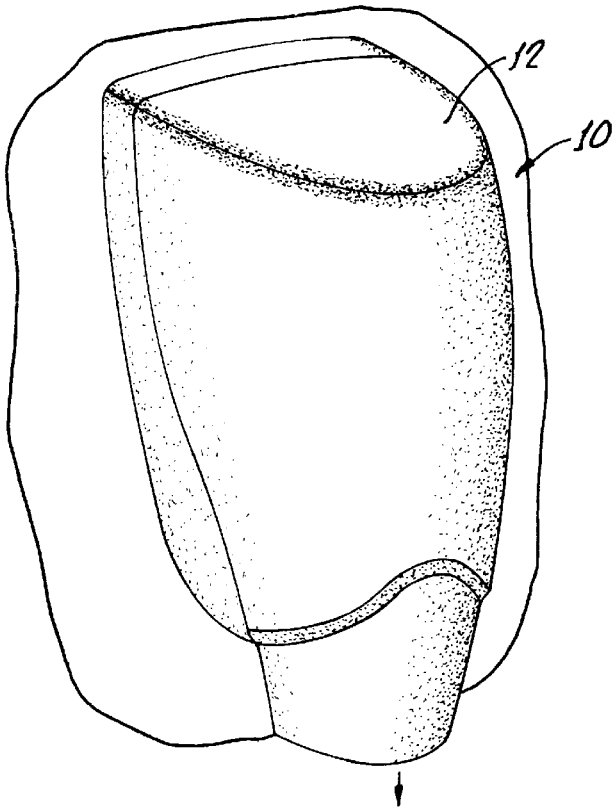
FIG. 1 is a perspective view of the present invention.
Figure 2:
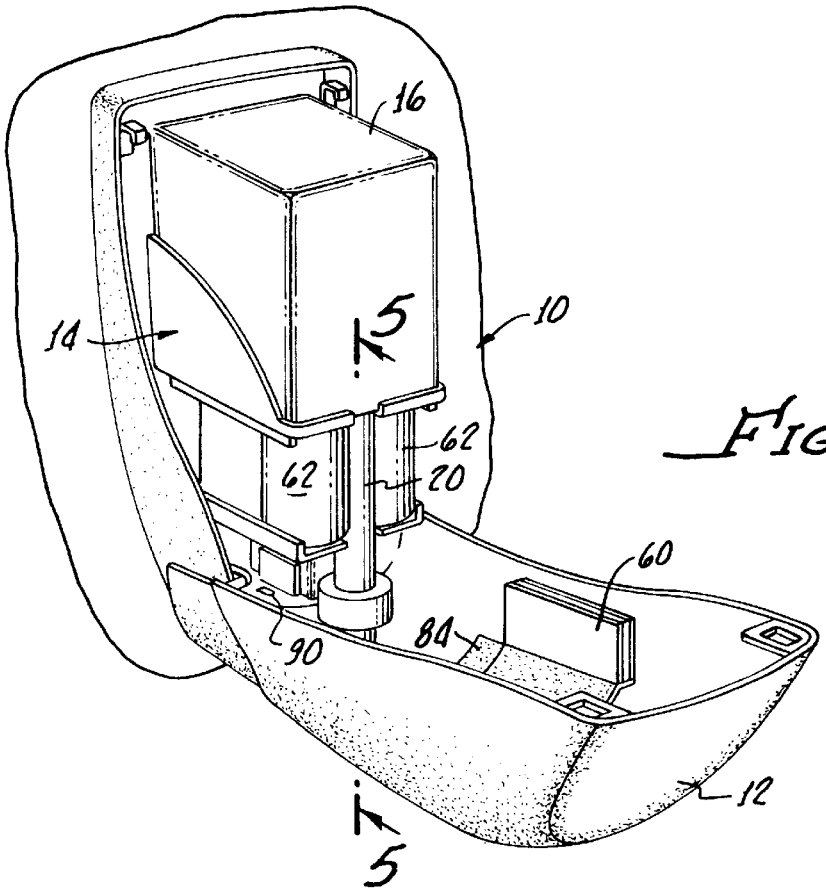
FIG. 2 is a perspective view of the present invention as shown with a case open to show a housing, a removable reservoir, and a dispensing tube attached thereto.

With reference to FIG. 1, there is shown a fluid dispenser 10 in accordance with the present invention generally showing a case 12 which may be opened, as shown in FIG. 2, to access a housing 14 along with a reservoir 16, the reservoir providing a means for containing a supply of fluid. A tube 20 provides a means for receiving fluid flow from the reservoir 16 by the force of gravity. Preferably the tube 20 is fixed to the reservoir 16 and removable with the reservoir 16 from the housing 14. Gravitational flow of fluid into the tube 20 eliminates any need for priming the tube as well as eliminating air bubbles as is the case with many prior art devices.

Figure 3:
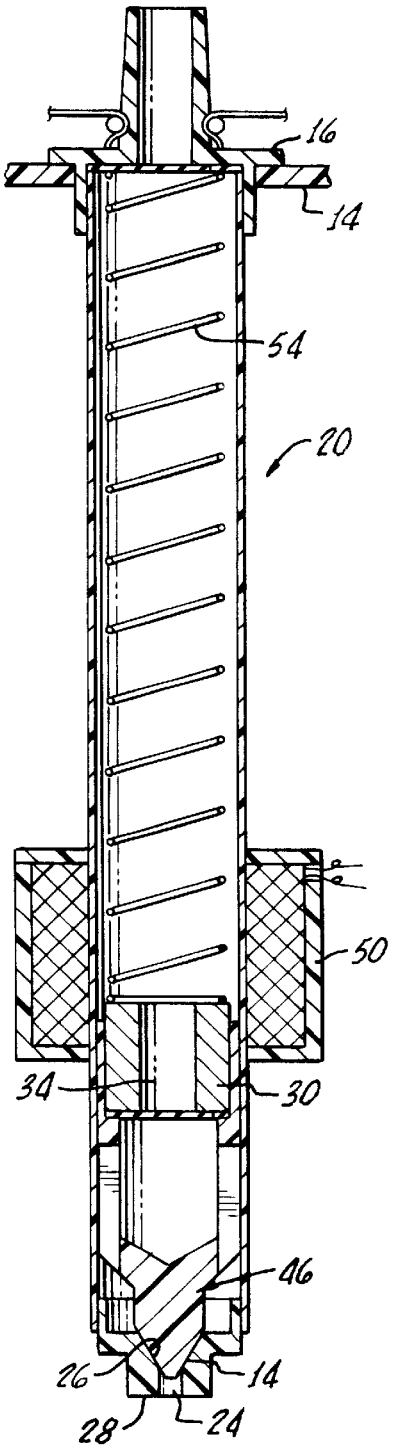
FIG. 3 is a cross sectional view of the tubular dispenser shown in FIG. 2, taken along the line 3—3, generally showing a spring and a plunger disposed within the tube.
Figure 4:
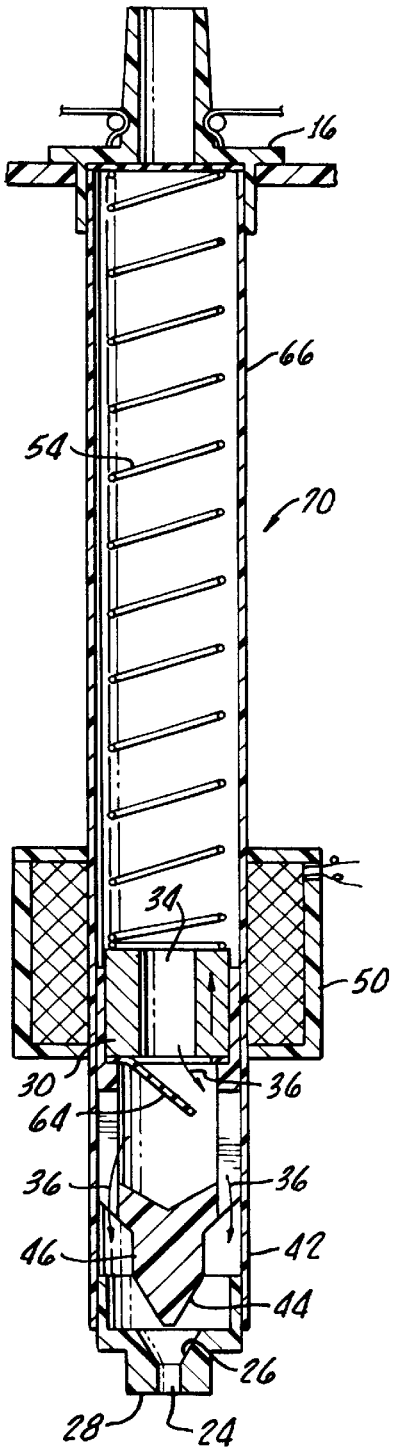
FIG. 4 is a cross sectional view similar to FIG. 3, showing movement of the plunger toward a surrounding magnetic solenoid with a first one-way valve open for enabling fluid flow into a lower portion of the tubular dispenser.
Figure 5:
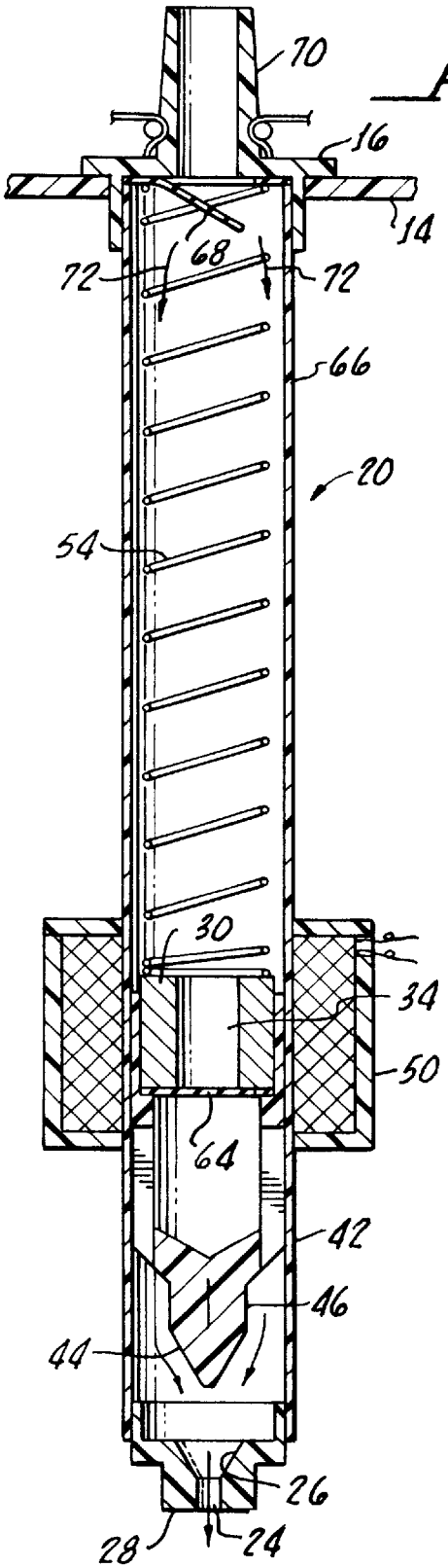
FIG. 5 is a cross sectional view similar to FIG. 4, showing the plunger beginning downward movement under the force of the spring, with the first one-way valve closed, and a second one-way valve, at a top of the tubular dispenser, open for enabling flow of fluid into the tube from the reservoir.

The dispensing tube 20 as shown in FIGS. 3–5 includes an orifice 24 along with a valve seat 26 at a dispensing end 28 of the tube 20.

A plunger 30 is slidably disposed within the tube 20 for movement between the first position shown in FIG. 3 and a second position shown in FIG. 5. The plunger 30 includes an opening 34 therethrough for enabling fluid to flow past the plunger 30 as shown by the arrows 36 in FIG. 4 to enable fluid flow into the lower portion 42 as will be hereinafter discussed in greater detail. A valve face 44 is provided on an end 46 of the plunger 30 for sealably engaging the valve seat 26 when the plunger 30 is in the first position. This valve arrangement adjacent the orifice 24 enables the stoppage of fluid flow without any subsequent dripping of fluid through the orifice 24, i.e., the valve is self-sealing.

As hereinabove noted and shown in FIGS. 3–5, the valve face 44 and valve seat 26 have mating angular surfaces which, by the sliding engagement therebetween, also provides for self-cleaning of the device because any build-up of fluid, or coagulated fluid is forced downward and outward during operation. This structure also provides for subsequent drip free operation.

A solenoid, or actuator, 50 is disposed and fixed to the housing 14 and adjacent the tube 20 to provide a means for magnetically engaging and moving the plunger 30 from the first position, as shown in FIG. 3, to the second position, as shown in FIG. 5. An interim position of the plunger 30 is shown in FIG. 4. Operation of the dispensing tube 20 will be hereinafter discussed in greater detail.

The solenoid is activated by an electrical current to move the plunger 30 to the second position, which is above the first position, and in which the valve face 44 is disengaged from the valve seat 26. Movement to the second position causes fluid flow past the plunger 30 into the tubular means lower portion 42, as shown by the arrow 36 in FIG. 4.

Preferably, the solenoid 50 is in the shape of a torroid which enables easy removal of the tube 20 therefrom when replacing the reservoir attached thereto. Alternatively, the reservoir may be manually refilled in situ, if desired. However, reliable dispensing fluid is best achieved when the reservoir 16 and 20 are removed from the housing 16 and replaced with a full reservoir 14.

A spring 54 disposed within the tube 20 provides a means for forcing the plunger 30 from the second position to the first position upon deactivation of the solenoid 50 in order to force fluid in the tube lower portion 42 through the orifice 24. Significant advantage is afforded by placement of the spring 54 within the tube 20 because the spring then becomes disposable with the reservoir 16 and tube 20. Consequently, malfunction of the spring 54, or deterioration of its properties over time, due to use or through contact with the fluid, will not occur. Further, a conventional inexpensive metal spring may be used since long term exposure to the fluid will not occur.

An additional important function of the spring is for providing a sealing force between the valve face 44 and valve seal 26, and providing force to ensure that the sliding engagement between the valve face 44 and valve seat 26 expels clotted fluid through the orifice 24.

Control system means 60 (FIG. 9) is provided for sensing the presence of a user's palm 62 (FIG. 7) beneath the orifice 24 and providing electrical current to the solenoid 50 for a duration of time. As hereinafter discussed in greater detail, the control system may be powered by batteries 62 (FIG. 2) disposed in the housing 14 and interconnected with the solenoid 50 in a conventional manner.

With reference to FIG. 4 a first one-way valve 64 may be provided for preventing fluid in the tubular means lower portion 42 past the plunger 30 as the plunger 30 moves to the first position. The valve 64 also enables fluid flow from a tube upper portion 66 into the tube lower portion 42 as the plunger 30 moves to the second position.

As shown in FIG. 5, when the solenoid 50 is deactivated, the plunger 30 is at the second position and is forced to the first position by the spring 54. The closed valve 64 thus ensures that all of the fluid disposed in the tube lower portion 42 is dispensed through the orifice 24.

It should be appreciated that the dispensing action of the tube 20 is effective without the one-way valve 64 in view of the various openings 34, orifice 24 and tube diameters. However, the most efficient operation is enabled through the use of the one-way valve 64 and a second one-way valve 68 disposed at a top 70 shown in open position.

Closure of this valve 68, as the plunger 30 moves to the second position as shown in FIG. 4, enhances the passage of fluid from the upper portion 66 of the tube 20 to the tube lower portion 42. Flow into the tube upper portion 66 occurs through the force of gravity and, further, by the drawing action of the plunger 30 as it moves from the second position to the first position, see FIG. 5, as indicated by the arrows 72. Thus, the valve 68 enhances the dispensing efficiency of the tube 20.

Figure 6:
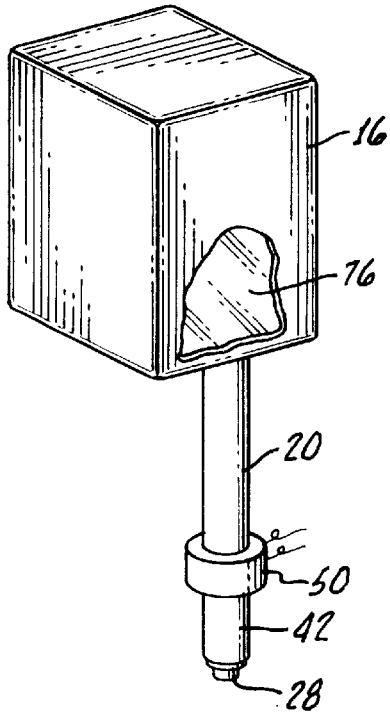
FIG. 6 is a perspective view of the reservoir and the dispensing tube removed from the housing.

As shown in FIG. 6, the reservoir may include a collapsible bag 76 for accommodating pressure differentials as the fluid passes from the reservoir 16 through the top 70 of the tube 20.

Figure 9:
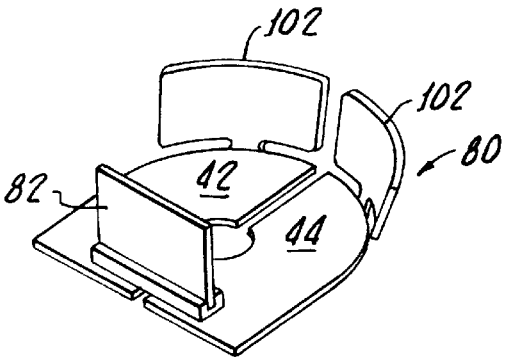
FIG. 9 is a block diagram of the control system in accordance with the present invention.
Figure 10:
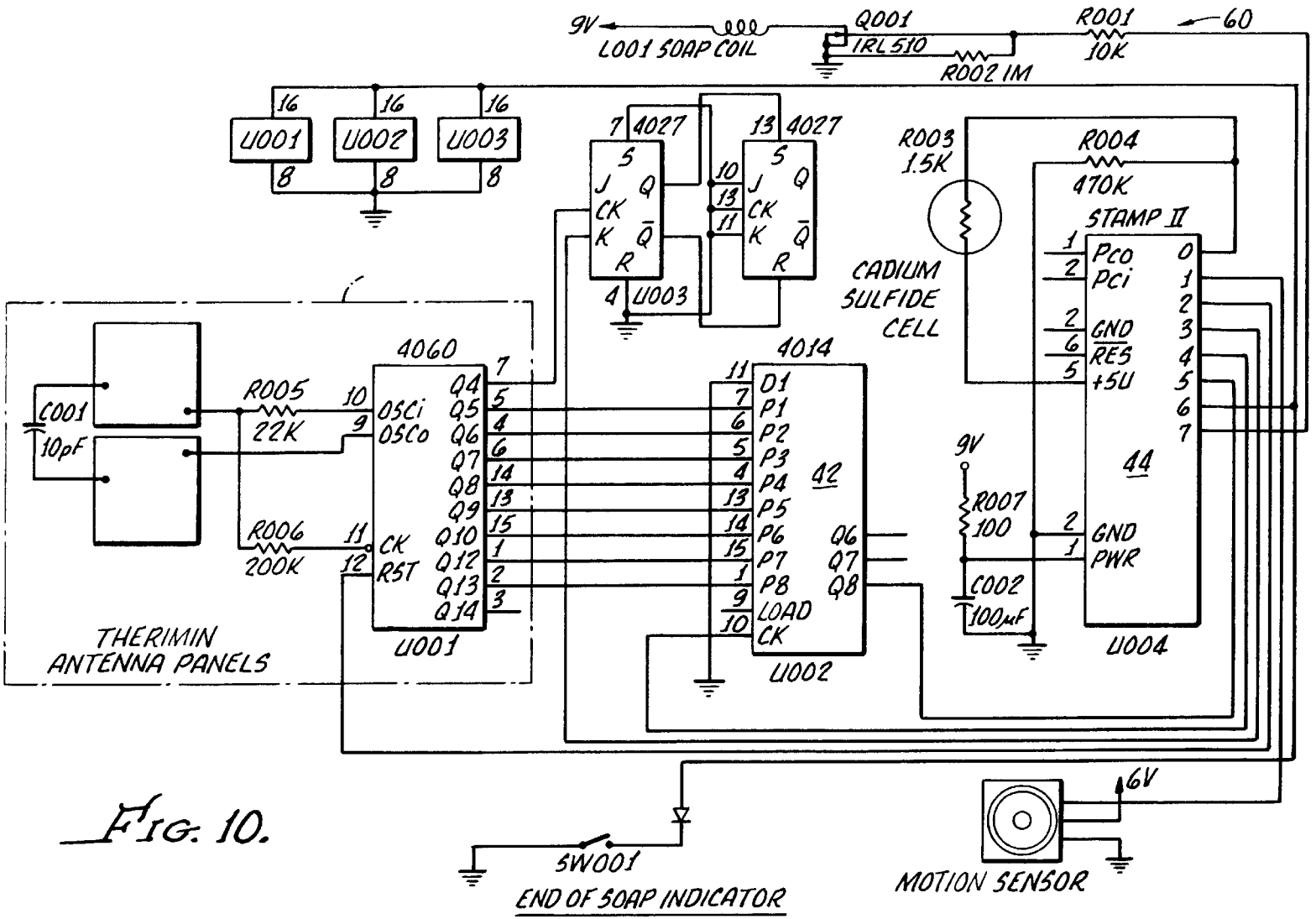
FIG. 10 is a schematic diagram of the control system in accordance with the present invention.

With reference now to FIG. 9, there is shown in block diagram form, the functioning elements of the control system 60 which includes a Theremin antenna 80 and an oscillator 82 which provides a signal upon sensing the presence of a user's palm 62 to a coil driver 86 which provides electrical current to the solenoid 50. A complete schematic diagram of the control system 60 is shown in FIG. 10 and further operational details are described in copending patent application Ser. No. 09/395,488. filed on even date herewith and entitled DISPENSING CONTROL SYSTEM. This referenced application is to be incorporated in its entirety for describing a control system 60 suitable for use in the present invention.

Figure 7:
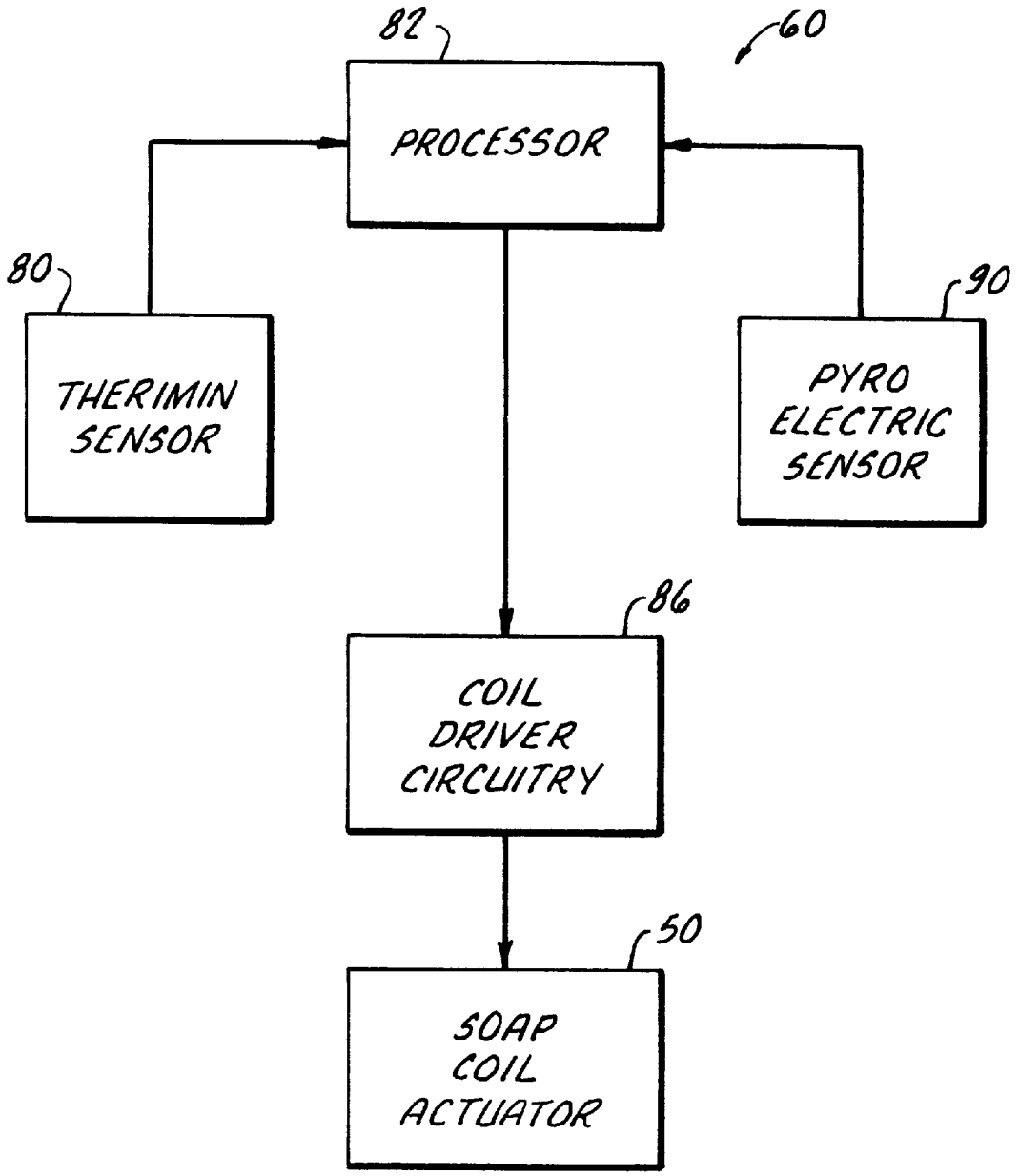
FIG. 7 is a cross sectional view of the dispenser in accordance with the present invention more clearly showing the Theremin antenna disposed in a spaced apart relationship with the valve seat and orifice along with a second sensor for confirming presence of a user's palm, a light sensor suitable for cutting power to the control system in order to preserve electrical power may also be provided.

Basically, the Theremin antenna 80 and oscillator 82 is variable voltage frequency source which produces a variable control frequency as the user's palm 62 approaches the antenna 80. (FIG. 7). This is utilized by the control system 60 to provide control current to the solenoid 50.

It should be appreciated that the Theremin antenna 80 includes two separated panels 92, 94 (see FIG. 8) to establish a capacitance therebetween which is detectably altered in the proximity of the user's hand 62. No separate ground is required and accordingly the dispenser 10 may be used at any location.

Figure 8:
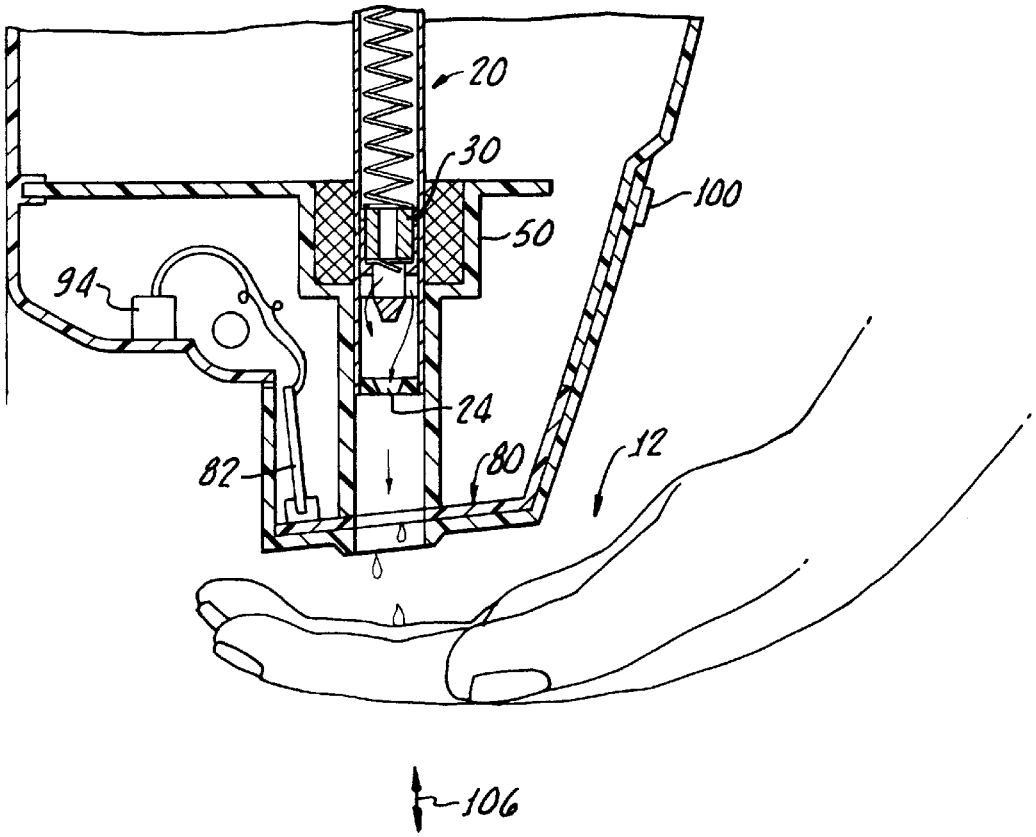
FIG. 8 is a perspective view of the Theremin sensor, or antenna, and a portion of the control means.

As shown in FIGS. 7 and 8, the Theremin antenna 80 includes spaced apart panels 92, 94 and upstanding portions 102 which provides a means for enabling the antenna 80 to generally conform to the user's palm 62. This conformation provides enhanced coupling between the user's palm 62 and the Theremin antenna 80 and accordingly provides greater sensitivity.

The plunger 30 and antenna 80 are vertically aligned to enable pump-like movement of the user's hand, as indicated by the arrow 106, to cause the control system 60 to provide pulsed electrical current to the solenoid 50 to cause pulsed release of fluid in a manner similar to conventional manual dispenser (not shown) which utilizes an activating lever.

In addition, the duration of presence of the user's palm enables a corresponding duration of electrical current to the solenoid 50 via the control means. This causes the plunger to move to a higher second position which accordingly disposes a larger fluid quantity.

A second sensor 94 may be provided which independently detects the presence of the user's palm. In this embodiment the control system 60 provides a signal to the coil driver 86 only upon confirmation of both the Theremin antenna 80 and the second sensor 94 sensing the presence of a user's hand 62.

It should be appreciated that the second sensor 94 may be of any type, such as an infrared detection system, ultrasound system, heat detector, audio detector, or a bicolor visible light detector, among others. The independent sensing of a user's hand and confirmation by the processor ensures that accidental or false signals will not be caused which would result in unwanted dispensing of fluid, as is the case in the prior art fluid dispensers.

With the use of batteries 62, power consumption is of utmost importance and a CdS sensor 100 may be provided to turn off the control system 60 upon low ambient light. Therefore, power is conserved at night or in commercial settings with automatic interior light control. The control system 60 is activated only when a user is present, the user's presence turning on an interior light in a conventional manner.

Although there has been hereinabove described a specific fluid dispenser in accordance with the present invention for the purpose of illustrating the manner to which the invention may be used to advantage, it should be appreciated that the invention is not limited thereto. Accordingly, any and all modifications, variations or equivalent arrangements which may occur to those skilled in the art, should be considered to be within the scope of the invention as defined by the appended claims.

What is claimed is:

1. A fluid dispenser comprising:

a housing;

reservoir means, disposed in said housing, for containing a supply of fluid;

tubular means for receiving fluid from said reservoir means by the force of gravity, said tubular means having an orifice and a valve seat disposed at a dispensing end of said tubular means;

a plunger slidably disposed within said tubular means for movement between a first and a second position, said plunger having an opening therethrough for enabling fluid to flow past the plunger and a valve face for sealably engaging said valve seat in the plunger first position;

solenoid means disposed in said housing adjacent said tubular means, for magnetically engaging and moving said plunger from the first position to the second position upon activation of said solenoid means by electrical current, the second position being above the first position with said valve face disengaged from said valve seat, movement of said plunger to the second position causing fluid flow past said plunger into a tubular means lower portion;

spring means, disposed within said tubular means, for forcing said plunger to the first position upon deactivization of said solenoid means in order to force fluid in the tubular means lower portion through said orifice and provide sealing pressure between the valve face and valve seat to prevent fluid leakage;

first one-way valve means for preventing fluid in a tubular means lower portion from flowing past said plunger as the plunger moves to the first position and enabling fluid from a tubular means upper portion to flow into the tubular means lower portion as the plunger moves to the second position; and control means for sensing the presence of a user's hand beneath said orifice and providing electrical current to said solenoid means for a duration of time.

2. The dispenser according to claim 1 wherein said tubular means is fixed to said reservoir means and removable therewith from said housing.

3. The dispenser according to claim 1 wherein said solenoid means has a torroidal shape and said tubular means is removably disposed therethrough.

4. The fluid dispenser according to claim 1 further comprising means for enabling self-cleaning of the valve face and valve seat, the means for enabling self-cleaning including mating angular surfaces on the valve face and valve seat in order to provide sliding engagement therebetween to expel any coagulated fluid.

5. The dispenser according to claim 1 further comprising second one-way valve means for preventing fluid flow out of the tubular means upper portion as the plunger moves to the second position and enabling fluid flow into the tubular means upper portion on the plunger moves to the first position.

6. The dispenser according to claim 1 wherein said control means includes a Theremin antenna for sensing the presence of the user's hand.

7. The dispenser according to claim 6, wherein said Theremin antenna is disposed at a bottom of said housing in a spaced apart relationship with said valve seat and has an aperture for passage of fluid therethrough.

8. The dispenser according to claim 7, wherein said aperture is disposed in a relatively horizontal portion of said Theremin antenna, and said antenna further includes upstanding portion means for enabling the antenna to generally conform to a shape of a user's palm.

9. The dispenser according to claim 7, wherein said plunger, valve seat and antenna are vertically aligned to enable movement of said plunger, via activation of said solenoid means by said control means, by vertical upward and downward movement of a user's palm below the antenna, said control means providing electrical current to said solenoid means upon each upward movement of the user's palm.

10. The dispenser according to claim 6, wherein said control means includes a second sensor means for sensing the presence of the user's hand and processing means for providing electrical current to said solenoid means upon confirmation of both the Theremin and the second sensor means sensing the presence of the user's hand.

11. The dispenser according to claim 1 wherein said control means includes first and second sensor means for sensing the presence of the user's hand and processing means for providing electrical current to said solenoid means only upon confirmation of both sensors means sensing the presence of the user's hand.

12. The dispenser according to claim 1 further comprising light sensor means for deactivating said control means at a low light level in order to conserve electrical power.

13. A fluid dispenser comprising:

disposable reservoir means for containing a fluid and including tubular means, depending from the reservoir and receiving fluid therefrom, for dispensing different measured quantities of said fluid, said tubular means including a fluid dispensing orifice;

plunger means for forcing said measured quantities of fluid through said orifice;

solenoid means disposed adjacent said tubular means for magnetically engaging and moving said plunger means causing said plunger means to force said measured quantities of fluid through said orifice; and control means including a Theremin antenna for sensing a duration of the presence of a user's hand beneath said orifice and providing a corresponding electrical current to said solenoid means to enable said solenoid means to magnetically engage and move said plunger to dispense the different measured fluid quantities dependent of the duration of user's hand presence, said Theremin antenna being disposed below said plunger means at a spaced apart distance therefrom and having an aperture for passage of fluid therethrough.

14. The dispenser according to claim 13 wherein said antenna further includes upstanding portion means for enabling the antenna to generally conform to the shape of a user's palm.

15. The dispenser according to claim 13 wherein said plunger means and antenna are vertically aligned to enable movement of said plunger means, via said solenoid means and control means, by vertical upward and downward movement of a user's palm below said antenna, said control means providing electrical current to said solenoid means upon each upward movement of the user's palm.

16. The dispenser according to claim 13 wherein said solenoid means is torroidal and said tubular means is removably disposed therethrough.

17. The dispenser according to claim 13 wherein said plunger means is disposed within said tubular means for movement between a first and a second position, said plunger means having an opening therethrough for enabling fluid to flow past said plunger means, said tubular means including an orifice valve having a valve seat and a valve face, said valve face being fixed to said plunger means.

18. The dispenser according to claim 17 wherein said solenoid means is disposed adjacent said tubular means in a position for moving said plunger means between a first and a second position, said valve face sealably engaging said valve seat in the first position, the second position being above the first position with said valve face disengaged from said valve seat, movement of said plunger means to the second position causing fluid flow past said plunger means into a tubular means lower portion.

19. The dispenser according to claim 18 further comprising spring means, disposed within said tubular means, for forcing said plunger means to the first position upon deactivization of said solenoid means in order to force fluid in the tubular means lower portion through said orifice and provide sealing pressure between the valve face and valve seat to prevent fluid leakage.

20. The dispenser according to claim 19 further comprising first one-way valve means for preventing fluid in the tubular means lower portion from flowing past said plunger as the plunger moves to the first position and enabling fluid in a tubular meals upper portion to flow into the tubular means lower portion as the plunger moves to the second position.

21. The dispenser according to claim 20 further comprising second one-way valve means for preventing fluid flow out of the tubular means upper portion as the plunger moves to the second position and enabling fluid flow into the tubular means upper portion as the plunger moves to the first position.

22. The dispenser according to claim 13 wherein said control means includes a second sensor means for sensing the presence of the user's hand and processing means for providing electrical current to said solenoid means only upon confirmation of both the Theremin antenna and the second sensor means sensing the presence of the user's hand.

23. The dispenser according to claim 13 further comprising light sensor means for deactivating said control means at a low light level in order to conserve electrical energy.

24. A fluid dispenser comprising:

a housing;

a reservoir, removably attached to said housing, for containing a supply of fluid;

a tube for receiving fluid from said reservoir by the force of gravity, said tube having an orifice and a valve seat disposed at a dispensing end of said tubular means;

a plunger slidably disposed within said tube for movement between a first and a second position, said plunger having an opening therethrough for enabling fluid to flow past the plunger and a valve face for sealably engaging said valve seat in the plunger from the first position to the second position upon activation of said solenoid means by electrical current, the second position being above the first position with said valve face disengaged from said valve seat, movement of said plunger to the second position causing fluid flow past said plunger into a tube lower portion;

a spring, disposed within said tube, for forcing said plunger to the first position upon deactivization of said solenoid means in order to force fluid in the tubular means lower portion through said orifice and provide sealing pressure between the valve face and valve seat to prevent fluid leakage; and a control system including a sensor for sensing the presence of a user's hand beneath said orifice and providing electrical current to said solenoid for direction of time, said sensor comprising a Theremin antenna, said control system including a second sensor for sensing the presence of the user's hand and processing means for providing electrical current to said solenoid means only upon confirmation of both the Theremin antenna and the second sensors sensing the presence of the user's hand.

25. The fluid dispenser according to claim 24 further comprising means for enabling self-cleaning of the valve face and valve seat, said last mentioned means including mating angular surfaces on the valve face and valve seat in order to provide sliding engagement therebetween to expel any coagulated fluid.

26. The dispenser according to claim 24 wherein said tube is fixed to said reservoir and removable therewith from said housing.

27. The dispenser according to claim 26 wherein said solenoid has a torroidal shape and said tube is removably disposed therethrough.

28. The dispenser according to claim 27 further comprising a first one-way valve for preventing fluid in the tubular means lower portion from flowing past said plunger as the plunger moves to the first position and enabling fluid in a tube upon portion to flow into the tube lower portion as the plunger moves to the second position.

29. The dispenser according to claim 28 further comprising a second one-way valve for preventing fluid flow out of the tube upper portion as the plunger moves to the second position and enabling fluid flow into the tube upper portion as the plunger moves to the first position.

30. The dispenser according to claim 24 wherein said Theremin antenna is disposed at a bottom of said housing in a spaced apart relationship with said valve seat and having an aperture for passage of fluid therethrough.

31. The dispenser according to claim 30 wherein said aperture is disposed in a relatively horizontal portion of said Theremin antenna, and said antenna further includes upstanding portion means for enabling the antenna to generally conform to the shape of a user's palm.

32. The dispenser according to claim 30 wherein said plunger, valve seat and antenna are vertically aligned to enable movement of said plunger, via activation of said solenoid means by said control means, by vertical approval and downward movement of a user's palm below the antenna, said control means providing electric current to said solenoid means upon each upward movement of the user's palm.

* * * * *